United States Patent [19]

Ditcher et al.

[11] Patent Number: 4,751,799

[45] Date of Patent: Jun. 21, 1988

[54] METHOD AND APPARATUS FOR LINING MANHOLE ASSEMBLIES AND THE LIKE

[75] Inventors: Jack Ditcher; James Westhoff, both of Langhorne; Eric Ditcher, Bensalem, all of Pa.

[73] Assignee: A-LOK Product, Inc., Tallytown, Pa.

[21] Appl. No.: 883,545

[22] Filed: Jul. 9, 1986

[51] Int. Cl.[4] ..... E02D 29/14

[52] U.S. Cl. ..... 52/21; 52/309.17; 404/25

[58] Field of Search ..... 52/20, 21, 249, 309.17, 52/309.14; 404/25; 138/147

[56] References Cited

U.S. PATENT DOCUMENTS

| | | | |
|---|---|---|---|
| 1,712,510 | 5/1929 | Monie | 52/20 |
| 2,816,323 | 12/1957 | Manger | 52/309.17 |
| 3,424,239 | 1/1969 | Coudray | 52/249 |
| 3,438,157 | 4/1969 | Monica | 52/20 |
| 3,439,461 | 4/1969 | Chandler | 52/309.17 |
| 4,089,139 | 5/1978 | Moffa | 52/20 |
| 4,128,981 | 12/1978 | Juba | 52/309.17 |
| 4,408,420 | 10/1983 | Haase | 52/309.17 |
| 4,592,674 | 6/1986 | Baliva | 52/20 |
| 4,621,941 | 11/1986 | Ditcher | 404/25 |

FOREIGN PATENT DOCUMENTS 2558469 12/1975 Fed. Rep. of Germany ..... 52/249

*Primary Examiner*—Henry E. Raduazo

*Attorney, Agent, or Firm*—Louis Weinstein

[57] ABSTRACT

Method and apparatus for providing liners in manhole assemblies, which liner is comprised of a plurality of liner sections joined together to form the inner corrosion resistant surface of each manhole member. The liner section define the inner surface of the manhole member being molded. Cast material is poured into the mold and allowed to set. The liner surface engaging the cast material contains integral substantially T-shaped projections which anchor the liner sections to the cast member. The tops and bottoms of each liner section extend around the surface of the section engaging the next adjacent section joined thereto to prevent toxic materials from reaching a cast material. The liner sections are theroplastic vacuum formed whereby the sheet forming the liner section is drawn against substantially T-shaped strips arranged upon the mold member within the vacuum thermo-forming equipment to provide the aforementioned integral T-shaped anchoring projections.

11 Claims, 4 Drawing Sheets

FIG.2b
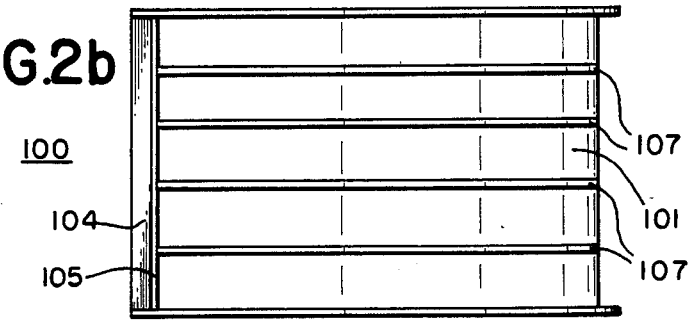
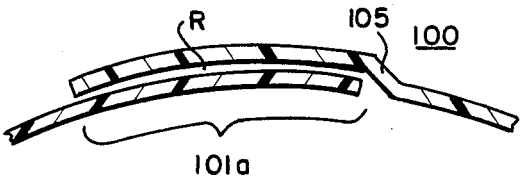
FIG. 2c
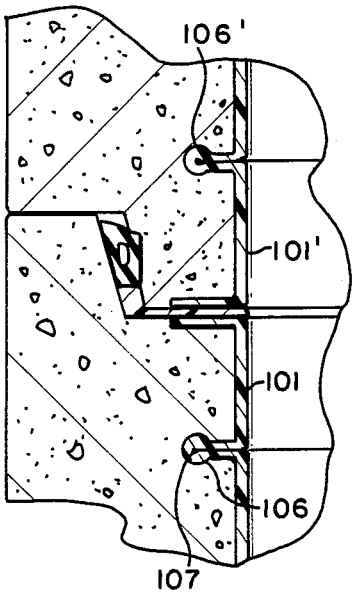
FIG. 2e
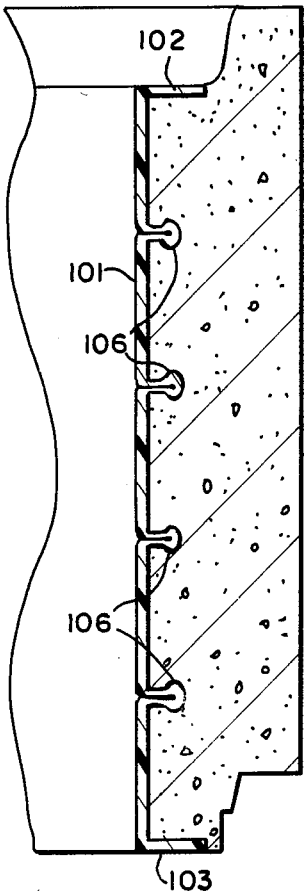
FIG. 2d

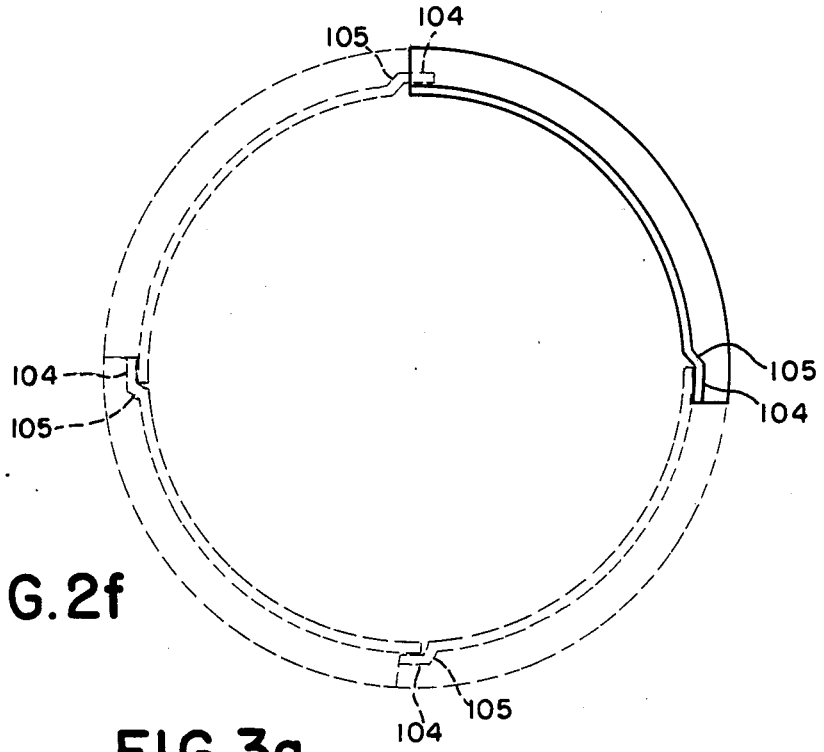
FIG. 2f
FIG. 3a
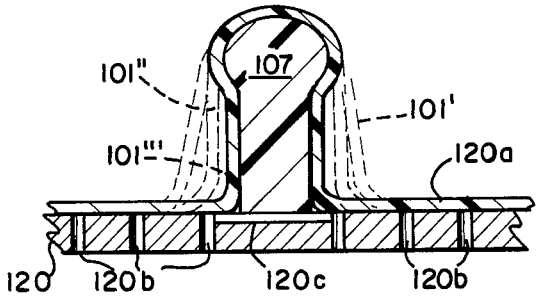
FIG. 3b
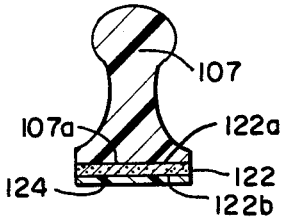
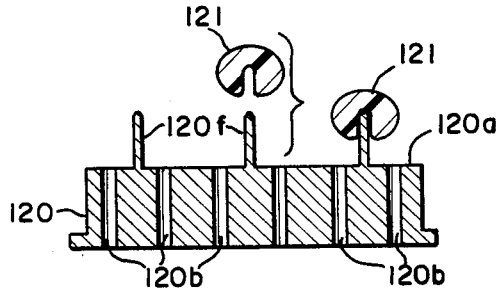
FIG. 3e
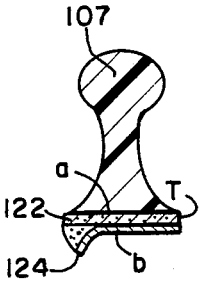
FIG. 3c
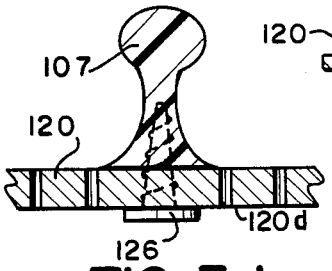
FIG. 3d

METHOD AND APPARATUS FOR LINING MANHOLE ASSEMBLIES AND THE LIKE

FIELD OF THE INVENTION

The present invention relates to manholes and more particularly to novel liner sections for use in protecting manhole assemblies against corrosion and a novel method for producing said sections and the manhole assemblies employing said sections.

BACKGROUND OF THE INVENTION

Manhole assemblies have been found to experience significant interior corrosion and deterioriation even in cases where high acidic effluents that are known to be harmful to sewers and sewer treatment are prohibited from entering the sewers without first being dissipated or neutralized. Nevertheless, hydrogen sulfide which is inherent in sewerage is developed due to the presence of sulfur compounds such as sulfate, sulfite or other inorganic or organic sulfur. The last mentioned compounds are reduced to sulfide by sulfate-reducing bacteria normally found in the effluent. The generation of hydrogen sulfide is accelerated when high temperatures and low flow rates are encountered. The useful life of concrete is determined by dividing the available effective thickness of the concrete by the corrosion rate which corrosion rate can be calculated when all factors are known. The effective thickness of the concrete is the amount covering the steel reinforcement embedded therein.

Coatings have been applied to manhole interiors but have been found to have a poor track record. For example, although coal tar epoxy provides effective protection against hydrogen sulfide, the coatings have provided poor field performance due to application difficulties.

As a result, linings of plastic material, such as polyvinylchloride (PVC), provide the best performance for interior corrosion protection against hydrogen sulfide. Such plastic linings are further compatible with plastic pipe now being used extensively in sanitary systems. To date, however, it is extremely difficult to fabricate interior linings and integrate such interior linings into vertical structure and particularly manhole assemblies. Flexible type linings are presently used in pipes covering the upper 270 degrees of the pipe interior. This is the portion attached by the $H_2S$ generated from sewerage. This flexible material is not easily used on manholes which requires 360 degrees protection for the manhole interior.

BRIEF DESCRIPTION OF THE INVENTION

The present invention provides a novel liner structure and a method for producing manhole assemblies utilizing such liners.

The liners, according to the principles of the present invention, are fabricated in sections. The lines are rigid or semi-rigid for ease of installation. For example, in one preferred embodiment the liner is formed as four separate quadrants. Each quadrant is preferably produced by a vacuum thermo-forming operation. A curved mold member is placed within the vacuum thermo-forming apparatus, said mold member being provided with small openings sufficient in number to effect the vacuum forming operation. Elongated strips having a dove-tail or T-shaped cross section are releasably secured to the curved mold member. A plastic sheet is heated and is then drawn against the mold member and about the aforementioned projections to form a liner section having integral dove-tail projections. The dove-tail serves the purpose of mechanically securing the liner to the concrete structure.

The liner sections are joined together and caulked along their engaging edges. The projections extend outwardly from the convex surfaces of the mold sections. The sections are either held against the surface of an interior mold member or, alternatively, are joined together, end-to-end, by suitable locking means and are held in the assembled position by standard plastic banding.

The cast material, typically concrete, is poured into the mold assembly and is allowed to set. Each of the members making up the manhole assembly, namely the manhole base, riser and top sections, are fabricated in a similar fashion.

The cast member is allowed to set and is removed from the mold assembly. However, the liner forms an integral part of the cast member and the cast member and integral liner are removed as a unitary body from the mold assembly. Since plastic does not bond naturally to concrete, the before-mentioned dove-tails are employed to secure the liner to concrete.

Each of the manhole sections which, as mentioned above, are formed in a similar fashion, are assembled one upon the other. The liners are provided with flanges at each of the mating surfaces of the adjoining sections. A resilient bonding means is provided between the mating flanges to assure the provision of an excellent liquid-tight seal therebetween. The liner protects the manhole assembly from corrosion and is retained in place due to the dove-tail anchoring means, assuring a rugged, serviceable liner for protecting the concrete sections.

OBJECTS OF THE INVENTION AND BRIEF DESCRIPTION OF THE FIGURES

It is therefore one object of the present invention to provide precast concrete vertical placed structures or manhole assemblies having novel liner structures impervious to toxic materials.

Still another object of the present invention is to provide a novel method for producing liners having novel anchoring means for securement within the sections of manhole assemblies.

Still another object of the present invention is to provide manhole assemblies including a novel method for producing such assemblies having liners which are impervious to toxic materials.

The above as well as other objects of the present invention will become apparent when reading the accompanying description and drawings in which:

FIGS. 1 and 1*a* show sectional views of a manhole assembly embodying the principles of the present invention;

FIGS. 2*a* and 2*b* show top and elevational views of a liner section employed in the assembly of FIG. 1;

FIG. 2*c* shows a detailed view of the manner in which two adjacent liner sections are mated and FIG. 2*f* shows the manner in which four such sections are mated;

FIG. 2*d* shows a sectional view of a liner section arranged within a manhole assembly section;

FIG. 2*e* shows an enlarged detailed view of the manner in which two manhole sections are joined;

FIG. 2*f* top sectional view showing all four liner sections in their assembled form;

FIGS. 3*a* through 3*e* show elevational views useful in explaining the manner in which the liner sections of FIGS. 2*a* through 2*e* are formed;

FIGS. 4*a* and 4*b* are partial views of mold assemblies useful in describing the manner in which manhole sections of the present invention are formed;

FIG. 5 shows a joining assembly for use in forming manhole sections through yet another molding technique.

DETAILED DESCRIPTION OF THE INVENTION AND PREFERRED EMBODIMENTS THEREOF

Figure 1:
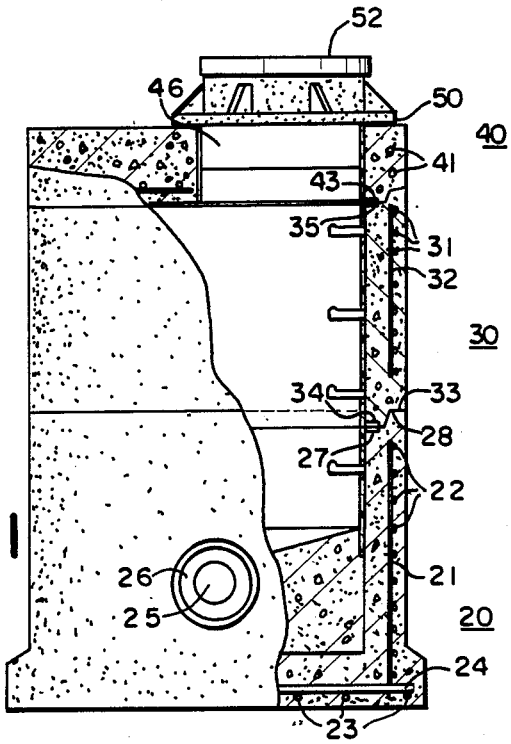

FIG. 1 shows a manhole assembly 10 comprised of base member 20, riser section 30 and top section 40. The base, riser and top sections have a cylindrical shape although the top section 40 in shorter then sections 20 and 30 and provides a top opening for receiving the cast iron frame and sewer lid cover shown in dotted fashion respectively at 50 and 52 in FIG. 1.

Base member 20 is formed of concrete and has a steel reinforcing framework comprised of a grid work of vertically (straight) and horizontally aligned (annular) rods 21 and 22 respectively. A similar grid framework of perpendicularly arranged (straight) rods 23 and 24 are provided in the floor of base member 20, as is conventional.

Base member 20 is provided with at least first and second openings, one of which is shown at 25, each for receiving one end of a pipe section. A resilient rubber-like seal 26 is arranged within opening 25 to provide a water-tight seal between the pipe section and the manhole opening.

The top edge of base member 20 is provided with an interior shoulder 27 having an outer projection 28 surrounding shoulder 27.

Cylindrical-shaped riser section 30 has a similar reinforcement structure comprised of horizontally aligned (straight) and vertically aligned (annular) steel rods 31 and 32. The bottom edge of the riser section has an outer shoulder 33 which rests upon the top surface of projection 28 and has an interior projection 34 surrounded by shoulder 33 and resting upon shoulder 27. The top end of riser section 30 is provided with an inner shoulder 35 and a surrounding outer projection 36 similar to the shoulder 27 and projection 28 of base member 20.

Figure 1A:
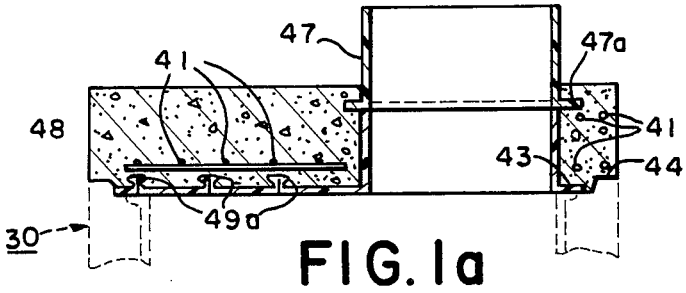
Figure 2A:
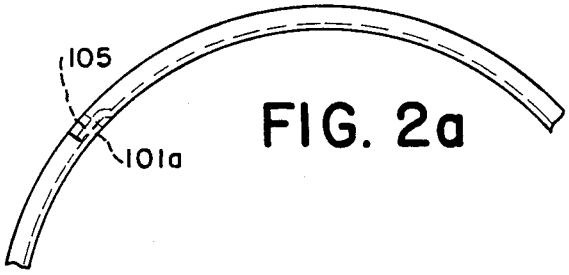

The top section 40 is reenforced by horizontally aligned (annular) reenforcement rods 41 and a reenforced steel plate 42, when required. Top section 40 has a tapered conical shape and a bottom edge having an outer shoulder 44 resting upon projection 36 and an inner projection 43 resting upon shoulder 35. A cast iron cover support frame 50 rests upon the top surface 45 of top section 40 and is aligned with opening 467. A water lock entry sleeve 47 has a flange 47*a* (FIG. 1*a*) extending into the cast material. A cylindrical shaped protective liner 49 to be more fully described is mounted with the lower portion of opening 46 to provide corrosion protection.

Each of the sections 20, 30 and 40 is provided with a corrosion protecting liner assembly 60, 70 and 80, each of which lines the interior surface of the associated manhole section and thereby protects the section from corrosion. Each liner assembly is provided with outwardly directed flanges at the upper and lower ends thereby, which flanges engage flanges of the adjacent liner assembly in a manner to be described in greater detail hereinbelow. A caulking material is placed between the adjacent flanges to assure a water-tight corrosion resistant seal in the region of said mating flanges.

FIGS. 2*a* through 2*d* show a typical liner section 100 in greater detail. The liner assembly provided within each manhole section is formed in sections (FIG. 2*f*). In one preferred embodiment, the liner assembly is formed in four separate 90 degree quadrants. This 90 degree quadrant section could be changed relative to the manhole diameter (For ease or fabricating, handling and shipping). FIGS. 2*a* through 2*d* show a quandrant 100 having a curved portion 101 with integral flanges 102 and 103 provided at the upper and lower ends thereof. One end of liner section 100 is sharply curved at 105 (see FIG. 2*c*) to form flange 104 which is arranged to engage the marginal portion 101*a* of the next adjacent liner section.

Each liner section 100 is further provided with a plurality of integral dove-tail or substantially T-shaped projections 106 which extend into the concrete and serve to anchor the liner section within the cast member as will be described.

FIG. 2*e* shows an enlarged detailed view of two of such sections 101,101' wherein the main body portion is provided with a plurality of such dove-tail projections 106, 106' (note also FIG. 2).

Each dove-tail projection is of an elongated projection having a substantially T-shaped (i.e. dove-tail) cross-section. The sheet forming section 100 is snuggly wrapped about and fused to an elongated strip 107 preferably in a vacuum thermo-forming operation.

The manner in which the sheet sections are formed is as follows:

Initially, as is shown in FIG. 3*a*, a curved mold sheet 120 is provided. Sheet 120 has a curved upper surface 120*a* which defines the curvature of the liner section. Sheet 120 curves in a direction perpendicular to the plane of FIG. 3*a*. The mold sheet 120 is provided with a plurality of openings 120*b* arranged over the entire surface of the mold sheet 120 in order to draw the plastic sheet employed to form the liner section 101 against surface 120*a* preferably by means of a vacuum.

A plurality of elongated strips 107 having the aforesaid dove-tail cross-section are placed upon the surface of mold sheet 120 in spaced parallel fashion and follow the curvature of the mold sheet 120. The technique employed for affixing the strips may for, for example, be that shown in FIGS. 3*b* and 3*c* wherein a tape strip 122 has its surface 122*a* adhesively secured to the underside 107*a* of strip 107. The opposite surface 122*b* has a similar adhesive coating which is protected prior to use by a removable cover strip 124. The cover strip is peeled away as shown in FIG. 3*c* and the elongated strip 107 is placed upon surface 120*a* of mold sheet 120 and is held thereon by the double-sided adhesive tape strip 122. Guide lines and/or a slight recess 120*c* may be provided upon surface 120*a* to facilitate alignment of strip(s) 107 upon surface 120*a*.

Another technique, which is shown in FIG. 3*d* releasably secures strip 107 to mold sheet 120 by means of a tack 126 whose head is arranged against the underside 120*d* of mold sheet 120 and whose tapered body extends through mold sheet 120 and the lower portion of elongated strip 107. It should be understood that a plurality of fasteners (i.e. tacks) 126 are utilized, said fasteners being arranged at spaced intervals along the mold sheet 20 and hence strip 107. If desired, the fastening member employed may also be either a pin or a threaded member.

Another technique shown in FIG. 3*e* is to provide integral, permanently formed, very thin, elongated vertical ribs 120*f* on the surface of 120*a* of mold 120. An elongated plastic extrusion 121 having a longitudinal slot 121*a* is placed over the rib so that its slot 121*a* receives a rib 120*f* to form the enlargement bulb or dove-tail in the plastic liner which is ultimately drawn around the extruded plastic strip 121 during the thermo-forming opertion.

The sheet to be molded is placed upon the mold sheet 120 containing strips 107 (or 121). The aforementioned components 101 and 107 are then heated. After being sufficiently heated, which heating operation is performed in a fast and controlled manner, a vacuum is applied to the undersurface of mold sheet 120 causing a vacuum to be applied to the undersurface of plastic sheet 101'. The vacuum draws the plastic sheet against surface 120*a* and further draws the sheet against the outer surface of strip 107 (or 121), the sheet being drawn inwardly in the manner shown by dotted lines 101'' and 101''', until the sheet is drawn against elongated strip 107 (or the strip 121) so that it firmly engages the entire exposed surface of strip 107 (or 121).

The sheet 101' is thereafter cooled and removed from the vacuum thermo-forming equipment which may, for example, be the Series XX machine manufactured by Plasti-Vac Inc.

Since the sheet quadrants are all substantially identical in configuration, the molding operation requires only a single mold sheet, thus simplifying both the technique and the amount of equipment required.

The manhole assembly 10 of FIG. 1 is further provided with a plurality of steps 54 provided along one vertical portion thereof to facilitate ingress and egress by inspectors, maintenance personnel and the like. The liner sections positioned in the portions of the manhole assembly having the aforementioned steps are stamped to form openings for receiving the ladder members 504.

The cylindrical liner member 49 (FIGS. 1, 1*a*) may be molded in a similar fashion and is provided with dove-tail-shaped anchoring strips 49*a* formed throug the use of either one of the techniques shown in FIGS. 3*a* and 3*e*.

Figure 4A:
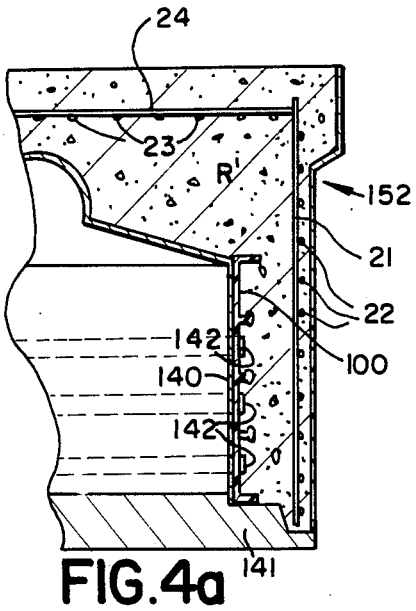

The technique for forming the manhole sections are as follows:

Considering the mold assembly shown in FIG. 4*a*, a manhole base is cast "upside-down" employing an inner mold member 140 and an outer mold member 150 resting on a base mold member 141. Only half of the mold assembly is shown for purposes of simplicity.

The liner sections are arranged against the outer surface of the inner mold 140 as shown, for example, by liner section 100. The region R between overlapping portions of the liner section (see FIG. 2*c*) are caulked with a suitable caulking material such as, for example, silicon or butyl rubber caulking.

The liner sections are retained against the inner mold member 140 by clamping bands 142 (formed of either plastic or metal) encircling the liner sections and thereafter tightened to retain the liner sections against the outer surface of inner mold member 140. A steel reenforcing framework made up of steel rods 21 and 22 and 23 and 24 arranged in grid-like fashion (note also FIG. 1) is inserted into the mold. Thereafter the cast material, preferably concrete, is poured into the hollow region R' of the mold assembly and allowed to set.

Once the cast material is set, the entire assembly is inverted whereupon the cast member is now "right-side-up". The mold members are then lifted away from the cast member.

The dove-tail shaped projections 106 serve to anchor the liners within the cast member. The riser and top sections are formed in a substantially similar manner using mold assemblies similar to those described above.

The liner sections which receive the ladder members receive a plastic insert 143 (see FIG. 4*b*) pressed into said openings prior to casting and thereby forming openings within the cast member for receiving the free ends of the substantially U-shaped ladder members. These plastic inserts are described in detail in U.S. Pat. No. 3,974,615 assigned to the assignee of the present invention. After the cast member is set and removed from the mold assembly, the ladder members are pressed into the aforementioned inserts.

The surface 29 within base member 20 (see FIG. 1) is preferably coated with an epoxy having silica added at 29*a* to provide a non-skid surface which is substantially corrosion resistant.

Figure 4B:
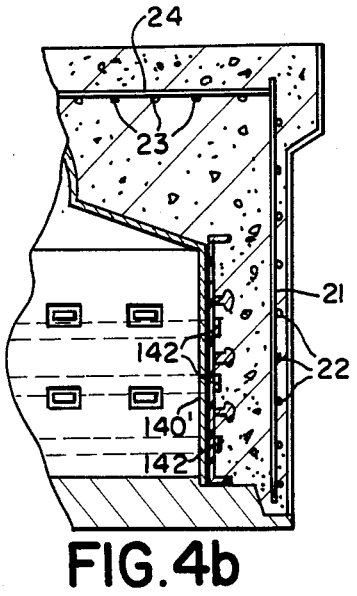

The molding technique described hereinabove, is typically referred to as a single-pour technique in that the invert and non-skid surface 29 is formed at the same time as the base member. It should be understood, however, that the use of liners in forming manhole sections may be utilized in the two-pour technique shown in FIG. 4*b* wherein the invert portion is formed in situ (i.e. at the final installation site). FIG. 4*b* shows the mold assembly utilized for the two-pour technique which is substantially identical to the single-pour technique except that the invert is not formed at this initial casting stage. However, the technique employed is substantially identical to that described in connection with FIG. 4*a* wherein the liner sections are placed against the outer surface of inner mold 140', the overlapping regions R (see FIG. 2*c*) are caulked; clamps 142 are wrapped about liner sections; the reenforcing rod arrangement is placed within the mold and the cast material is poured into mold.

After the cast material has been set, the mold assembly which casts the member in "upside-down" fashion is turned upright; the inner mold member 140 is removed and the cast member, which is now set, is removed from the outer mold member 152.

In still another casting technique, the inner mold member may be dispensed with by using thicker liner sections as a substitute for the inner mold member, to provide suggicient strength for supporting the cast material.

Figure 5:
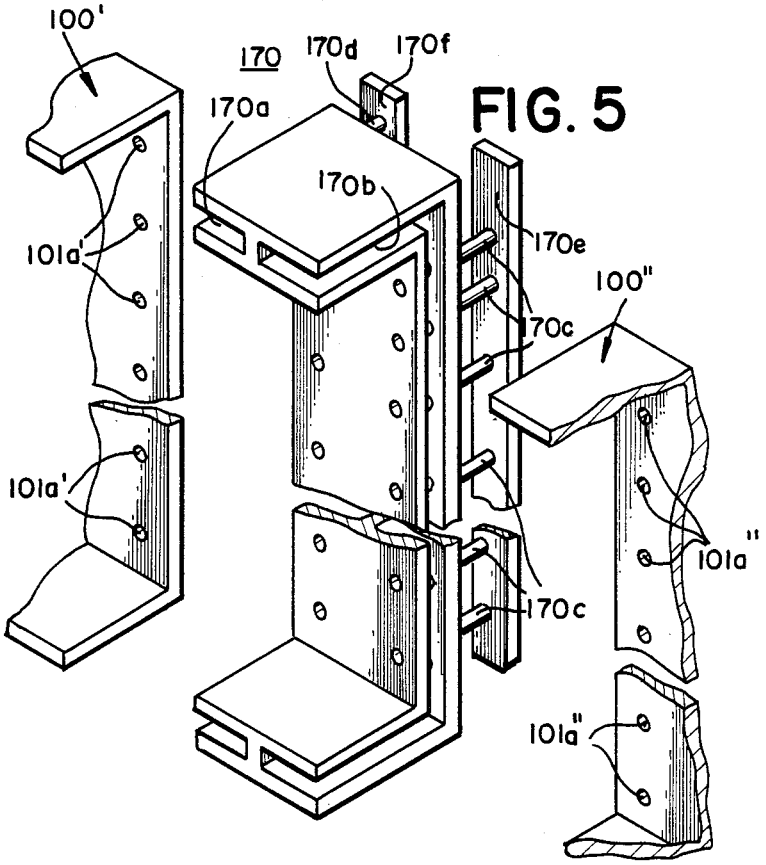

As shown in FIG. 5, the adjacent ends 100' and 100'' of the liner sections are inserted into the grooves 170*a*, 170*b* of joining member 170. Butyl, silicon or other suitable caulking material is placed within groove 170*a* so that groove 170*a* is overfilled with caulking to provide a squeeze-out joint ($H_2S$ resistance), 170*b* to provide a good liquid-tight, corrosion resistant seal in the region between the joined elements 100', 170 and 100''.

Pins 170*c*, 170*d* inserted into openings in the outwardly directed flanges 170*e*, 170*f* are inserted into openings 101*a'* and 101*a''* in sheets 100' and 100'' to lock the liner sheets 100' and 100'' to the joining member 170. The engaging surface regions between flanges 170*e* and 170*f* and the marginal portions of liner sections 100' and 100'' are likewise caulked to provide a good liquid-tight and hence corrosion resistant seal. If desired, bands of the type employed in the molding techniques shown, for example, in FIGS. 4*a* and 4*b* may also be employed to retain the joined members 100', 170 and 100'' in place either together with or as an alternative to the cooperating pins 170*c* and 170*d* and openings 101*a'* and 101*a''* respectively.

Thereafter the cast member may be molded in a manner similar to that described hereinabove using only base mold member 141 and outer mold member 150. All of the manhole sections 20, 30 and 40 may be formed using any of the techniques described hereinabove.

After all the manhole members have been cast, and when they are assembled one upon the other, the engaging surfaces thereof are caulked with a suitable caulking material 111 as shown, for example, in FIG. 2*e*. An overabundance of the caulking material is preferably used so that when the members are properly stacked one upon the other some of the caulking material will be squeezed out thereby assuring that the entire region R' between the two joining members will be totally filled with the caulking material which is impervious to $H_2S$ gas or sulphoris acid condensate.

The liner is preferably formed of a plastic material highly resistant to acids and especially hydrogren sulfide and sulphuric acid. The sheet material may, for example, be fiberglass or any suitable thermoplastic such as PVC. The strips 102 may either be formed of the same plastic material or materials compatible with that chosen for sheet 101.

A latitude of modification change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A manhole assembly comprised of a plurality of manhole sections stacked one upon the other;

each of said manhole sections being formed of a cast material and having liner means formed of a sheet-like semi-rigid plastic material having a curved shape for lining the interior cylindrical surface of each manhole section said liner means conforming to the curvature of said cylindrical interior surface;

said liner means having integral, substantially dove-tail shaped projections encircling the curved surface of said liner means engaging said cast material, said integral, curved dove-tail projections conforming to the curved shape of said interior surface and being embedded in said cast material and having a configuration which anchors said liner means to said manhole section;

said manhole section being provided with an engaging annular surface for engaging the adjacent annular surface of the adjacent manhole section;

said liner means having flange means extending over at least a portion of said engaging annular surface whereby the outer surfaces of the flanges of adjacent manhole sections engage one another;

caulking means provided in the region between said engaging flange surfaces to provide in the region between said engaging flange surfaces a corrosion resistant seal to protect said cast material from corrosion;

each of said integral projection means comprising a portion of the sheet-like member which has been formed to yield said projections;

said liner means comprising a plurality of arcuate shaped liner sections;

portions of said adjacent sections being arranged to extend beyond said projections to overlap one another to form a continuous cylindrical-shaped liner for protecting the adjacent surface of the associated manhole section;

caulking means being provided in the region between overlapped portions of said liner sections.

2. The apparatus of claim 1 wherein one edge of each of said liner sections is offset relative to the major portion of said liner section for overlapping the marginal portion of the next adjacent liner section.

3. The apparatus of claim 1 wherein said liner means is comprised of at least two liner sections of substantially equal size.

4. The apparatus of claim 1 wherein said liner means is comprised of four liner sections of substantially equal size.

5. The apparatus of claim 1 wherein said liner means is formed of a suitable plastic material which is highly resistant to sulphuric acid.

6. The apparatus of claim 5 wherein said plastic material is taken from the group of material consisting of fiberglass and polyvinyl chloride (PVC). A.B.S., polyethylene and polypropylene.

7. A manhole assembly top section supportable upon a cylindrical-shaped manhole base or riser section and provided to support a manhole cover support frame, said top section having a substantially circular periphery and being formed of a cast material having a bottom surface with a downwardly extending annular flange for engagement with an annular supporting shoulder of the supporting member positioned therebeneath;

an opening extending through said top section having a diameter which is smaller than the diameter of the periphery of said top section;

a corrosion resistant liner having a cylindrical portion extending at least partially into said opening and having an integral outwardly extending flange covering substantially the entire bottom surface of said top surface to protect said bottom surface and said opening from corrosive influences;

said liner flange portion having elongated integral dove-tail-shaped projections arranged at spaced intervals along said flange and cast into and embedded in the cast material near the bottom surface of said top section for anchoring said flange to said top section and supporting said cylindrical portion in said opening.

8. The assembly of claim 7 wherein the flange extends over a portion of the supporting surface of the manhole section upon which the top section is resting;

caulking means provided in the region between the supporting surface of the section upon which the top section is resting and the bottom surface of said flange for providing a corrosion resistant seal to protect the cast material from corrsion.

9. The assembly of claim 7 wherein the anchoring projections are arranged between said opening and said flange.

10. The assembly of claim 7 wherein said opening is offset from the center of said top section, said top section having a substantially circular shaped periphery;

the cylindrical portion of said liner being offset from the center of said flange to conform to the arrangement of said top section.

11. The apparatus of claim 7 wherein the anchoring projections are aligned on said flange in a curvilinear fashion.

* * * * *

UNITED STATES PATENT AND TRADEMARK OFFICE

CERTIFICATE OF CORRECTION

PATENT NO. : 4,751,799

DATED : June 21, 1988

INVENTOR(S) : Jack Ditcher; James Westhoff; Eric Ditcher

It is certified that error appears in the above-identified patent and that said Letters Patent is hereby corrected as shown below:

On the title page:

At "[73] Assignee:" change "Tallytown" to --Tullytown--.

At Column 3, line 57, change "467" to --46--.

At Column 5, line 45, change "throug" to --through--.

At Column 6, line 52, change "suggicient" to --sufficient--.

Signed and Sealed this

Twenty-sixth Day of March, 1991

*Attest:*

HARRY F. MANBECK, JR.

*Attesting Officer*

*Commissioner of Patents and Trademarks*